US009251767B1

(12) United States Patent
Shaw

(10) Patent No.: US 9,251,767 B1
(45) Date of Patent: Feb. 2, 2016

(54) BALANCED STRINGED-INSTRUMENT PINKY SLIDE

(71) Applicant: Laurence Jay Shaw, San Francisco, CA (US)

(72) Inventor: Laurence Jay Shaw, San Francisco, CA (US)

( * ) Notice: Subject to any disclaimer, the term of this patent is extended or adjusted under 35 U.S.C. 154(b) by 160 days.

(21) Appl. No.: 13/971,833

(22) Filed: Aug. 20, 2013

Related U.S. Application Data

(63) Continuation-in-part of application No. 13/065,994, filed on Apr. 4, 2011, now abandoned.

(60) Provisional application No. 61/341,663, filed on Apr. 3, 2010.

(51) Int. Cl.
*G10D 3/00* (2006.01)

(52) U.S. Cl.
CPC ..... *G10D 3/00* (2013.01)

(58) Field of Classification Search
CPC ..... G10D 3/00; G10D 3/043
USPC ..... 84/315–319; D17/20
See application file for complete search history.

(56) References Cited

U.S. PATENT DOCUMENTS 3,854,368 A * 12/1974 Pogan ..... 84/319
5,251,527 A * 10/1993 Roberts ..... 84/319
6,160,212 A * 12/2000 Morse ..... 84/315

* cited by examiner

*Primary Examiner* — Jianchun Qin
(74) *Attorney, Agent, or Firm* — Integral Patent; Laurence J. Shaw

(57) ABSTRACT

A stringed-instrument slide (100) which is a truncated conical shell with the narrower end at the top (110) and with a roughly semi-circular cut-away (150) along the base (130), so a substantial portion of the mass is below the level of the finger-palm joint. The mass of the slide (100) is predominantly born by the region of contact of the slide (100) with the palm (98) rather than along the pinky (99) so the slide (100) has the sensation of being "balanced" and relatively "weightless" on the pinky (99) and the pressure applied by the pinky (90) corresponds closely to the actual pressure of the slide (100) on the strings, and the forces and torques required to move the slide (100) onto and off of the strings is reduced, thereby facilitating play, particularly rapid and/or nuanced play.

2 Claims, 3 Drawing Sheets

BALANCED STRINGED-INSTRUMENT PINKY SLIDE

RELATED APPLICATIONS

The present application is based on and claims the priority of non-provisional patent application Ser. No. 13/065,994 filed Apr. 4, 2011 having the title of "Balanced stringed-instrument slide" and being by the same inventor, which is based on and claims the priority of provisional patent application Ser. No. 61/341,663 filed Apr. 3, 2010 having the title of "Balanced stringed-instrument slide" and being by the same inventor.

FIELD OF THE INVENTION

The present invention relates to musical instruments, more particularly to stringed musical instruments, and still more particularly to slides used to play stringed musical instruments, particularly low string-tension and low-fretted stringed instruments.

BACKGROUND OF THE INVENTION

A popular method of guitar playing involves the use of a glass or metal cylinder worn on a finger to provide a slideable stop on one or more strings. The location of the slide along a string determines the pitch of the string when played. The position is continuously adjustable (as opposed to a fretted string where a string is pushed against one of a finite number of metal frets on the instrument) so glissandos and vibratos can be easily produced through motions of the slide along the string.

Stringed-instrument slides are typically cylindrical shells, i.e., the outer surface which contacts the instrument strings is cylindrical and the inner surface into which a finger is inserted is a coaxial cylindrical surface. Metal slides are lathe machined or cut from metal tubing. Glass slides were originally made from the necks or top portions of bottles, and the style of play is still often called bottle-neck slide. An advantage of simple cylindrical slides or slides with cylindrical symmetry is that if their diameter is sufficiently large they can be used on any finger. Another advantage of cylindrical slides or slides with cylindrical symmetry is that if the slide suffers a chip or scratch in one area, it can be rotated and an undamaged part of the surface can be used.

However, cylindrical slides have the disadvantage that the center of mass of the slide is located substantially above the finger-palm joint, typically by the length of somewhere between one and two finger joints. Therefore, the playing finger must bear the weight of the slide when the slide is held at an angle from vertical. Furthermore, the displacement of the center of mass from the pivot point at the finger-palm joint means that a substantial force is required to raise and lower the slide from the instrument strings. Furthermore, slide players generally prefer a tight fit of the slide on a finger, so slide manufacturers generally have to manufacture slides in a variety of sizes to fit a variety of finger sizes.

It is therefore an object of the present invention to provide a musical instrument slide with geometry, dimensions and weight distribution facilitating responsiveness, nuanced play, ease of use, etc.

It is another object of the present invention to provide a musical instrument slide for low-fretted stringed instruments and low string-tension stringed instruments.

It is another object of the present invention to provide a musical instrument slide where the base is contoured so that a substantial portion of weight of the slide is born on the palm.

It is another object of the present invention to provide a musical instrument slide where the weight distribution is balanced.

It is an object of the present invention to provide a musical instrument slide with geometry, dimensions and weight distribution that reduces the weight born by the finger operating the slide.

It is another object of the present invention to provide a musical instrument slide with geometry, dimensions and weight distribution that reduces the moment of inertia and therefore the torques and forces required to operate the slide.

It is an object of the present invention to provide a musical instrument slide where the center of mass is lowered.

It is another object of the present invention to provide a musical instrument slide where the center of mass is near the finger-palm joint.

It is another object of the present invention to provide a musical instrument slide where the base is contoured so that a substantial portion of mass of the slide is located below the level of the finger-palm joint.

It is another object of the present invention to provide a musical instrument slide which teeters on the finger with a pivot point at or near the top of the palm.

It is another object of the present invention to provide a musical instrument slide whose operation involves different physical principles than traditional musical instrument slides.

And also more particularly, it is an object of the present invention to provide a musical instrument slide where the center of mass is moved towards the plane of the palm, and more particularly near or on the plane of the palm, particularly over a range of orientations of the slide-bearing finger.

And still more particularly, it is an object of the present invention to provide a musical instrument slide where the geometry, dimensions and mass distribution are such that the moment of inertia for rotation about the pinky-palm joint is reduced.

Additional objects and advantages of the invention will be set forth in the description which follows, and will be apparent from the description or may be learned from the practice of the invention. The objects and advantages of the invention may be realized and obtained by means of the instrumentalities and combinations particularly pointed out in the claims.

SUMMARY OF THE INVENTION

A stringed-instrument slide having an internal cavity for housing a finger of a human hand, and a hard outer surface for providing a sliding stop on a string of a stringed instrument. The slide has a shape and mass distribution such that, when the slide is mounted on a finger with the finger pointing upwards, and a ratio of the vertical distance between the finger-palm joint and the center of mass of said slide to the vertical distance between the finger-palm joint and the top edge of the slide is less than 0.45.

A stringed-instrument slide having a conical outer surface, a coaxial conical inner surface, and a cut-away along the bottom edge. The conical inner and outer surfaces have flare angles between 4° and 15°, the diameter at the bottom is at least 15% larger than the diameter at the top, and the cut-away has a height along the longitudinal axis which is at least 5% the height of the slide.

A stringed-instrument slide having a substantially conical inner surface defining a housing for an upwards-oriented pinky finger of a human hand, and a hard, substantially conical outer surface providing a sliding stop on a string on a stringed-instrument, where the outer lower diameter is greater than an inner distance between the pinky finger and a middle finger of said hand. The slide has a crescent-shaped cut-away along the bottom edge of the slide, the apex of which is to be positioned at the finger-palm border between the pinky finger and ring finger.

BRIEF DESCRIPTION OF THE DRAWINGS

The accompanying figures, which are incorporated in and form a part of the present specification, illustrate embodiments of the invention and, together with the description given above and the detailed description of the preferred embodiments given below, serve to explain the principles of the invention.

DETAILED DESCRIPTION OF THE PREFERRED EMBODIMENTS

Figure 1A:
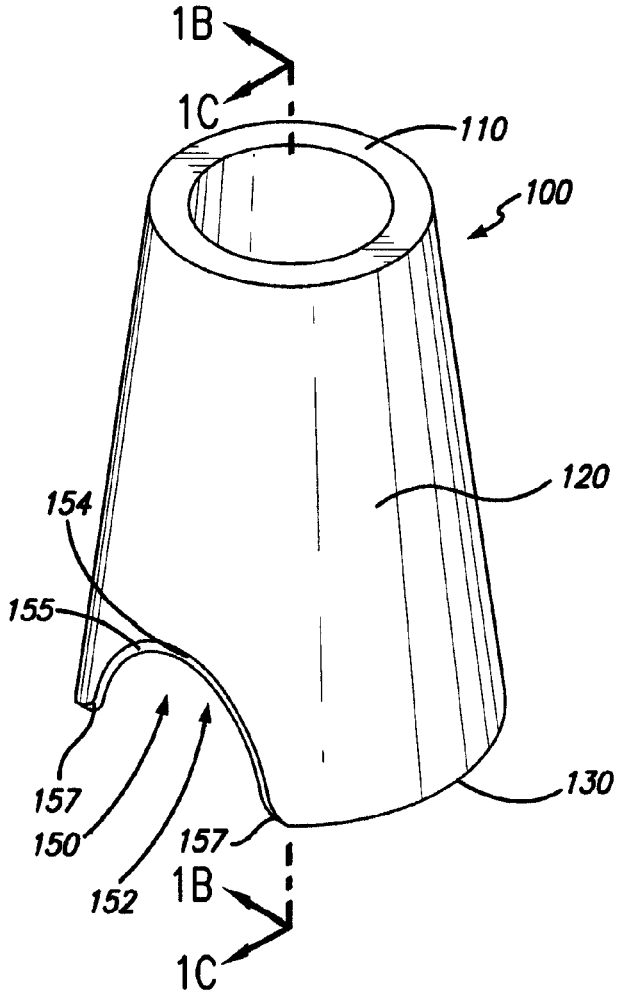
FIG. 1A is a perspective view of the stringed-instrument slide of the present invention.
Figure 1B:
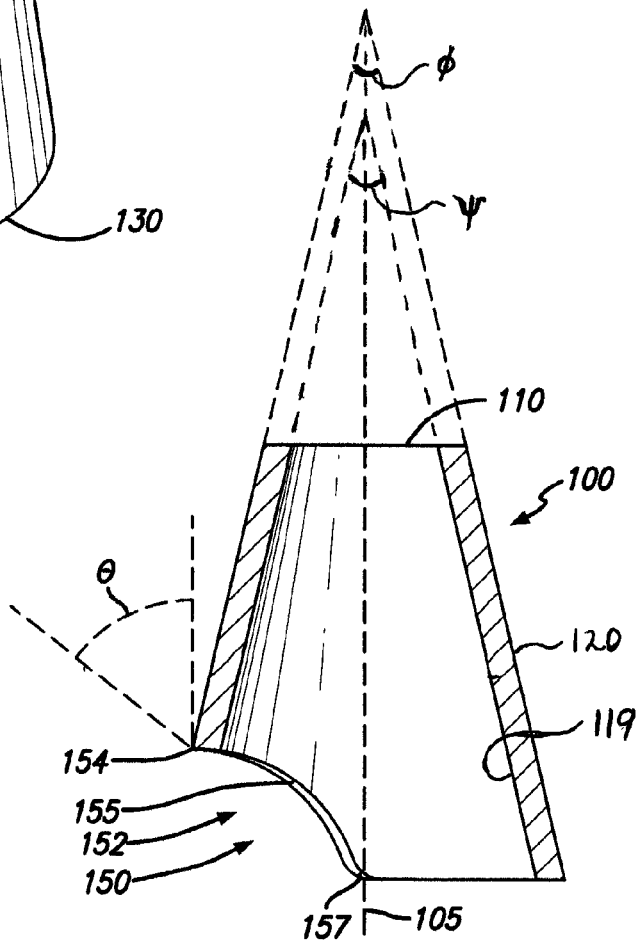
FIG. 1B is a cross-sectional side view of the stringed-instrument slide of the present invention shown in FIG. 1B.
Figure 1C:
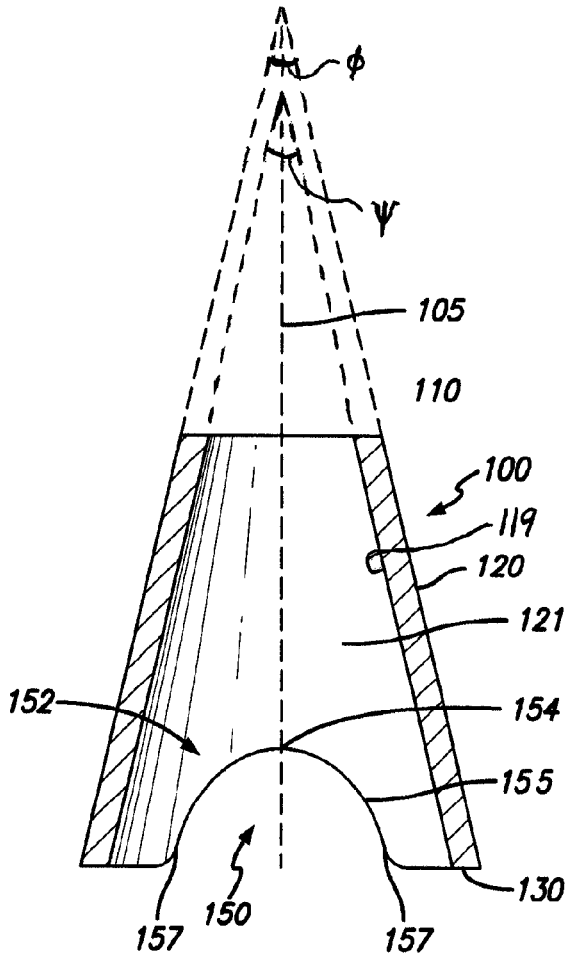
FIG. 1C is a cross-sectional side view of the stringed-instrument slide of the present invention rotated 90° from the view shown in FIG. 1B.
Figure 1D:
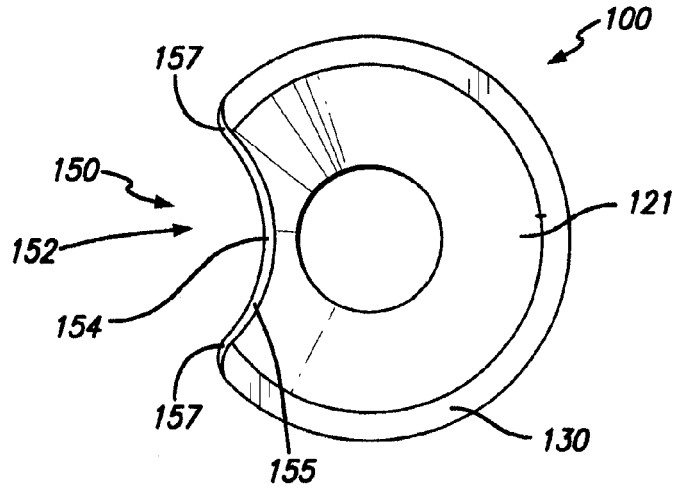
FIG. 1D is a bottom view of the stringed-instrument slide of the present invention.

As shown in perspective in FIG. 1A, in cross-sectional side view in FIGS. 1B and 1C, and in bottom view in FIG. 1D, the present invention is a balanced stringed-instrument slide (100). The slide (100) is essentially a truncated conical shell, i.e., the inner surface (121) and the outer surface (120) are substantially conical. The slide (100) has a ring-shaped top edge (110), and a ring-shaped bottom edge (130) with an arced (i.e., crescent-shaped) cut-away (150) on the bottom edge (130). According to an alternate embodiment, there is a slight concave curvature to the outer surface (120) of the slide (100) along the vertical, thereby facilitating the application of pressure to multiple strings. (In the present specification and claims the orientation of the slide (100) shown in FIGS. 1A, 1B, 1C and 2 is assumed when using the terms top, upper, bottom, lower, etc. Furthermore, in FIGS. 1A, 1B and 1C the longitudinal axis (105) is shown oriented in the vertical direction and in the present specification and claims "vertical" is to be understood to mean along the direction of the longitudinal axis (105).)

Figure 2:
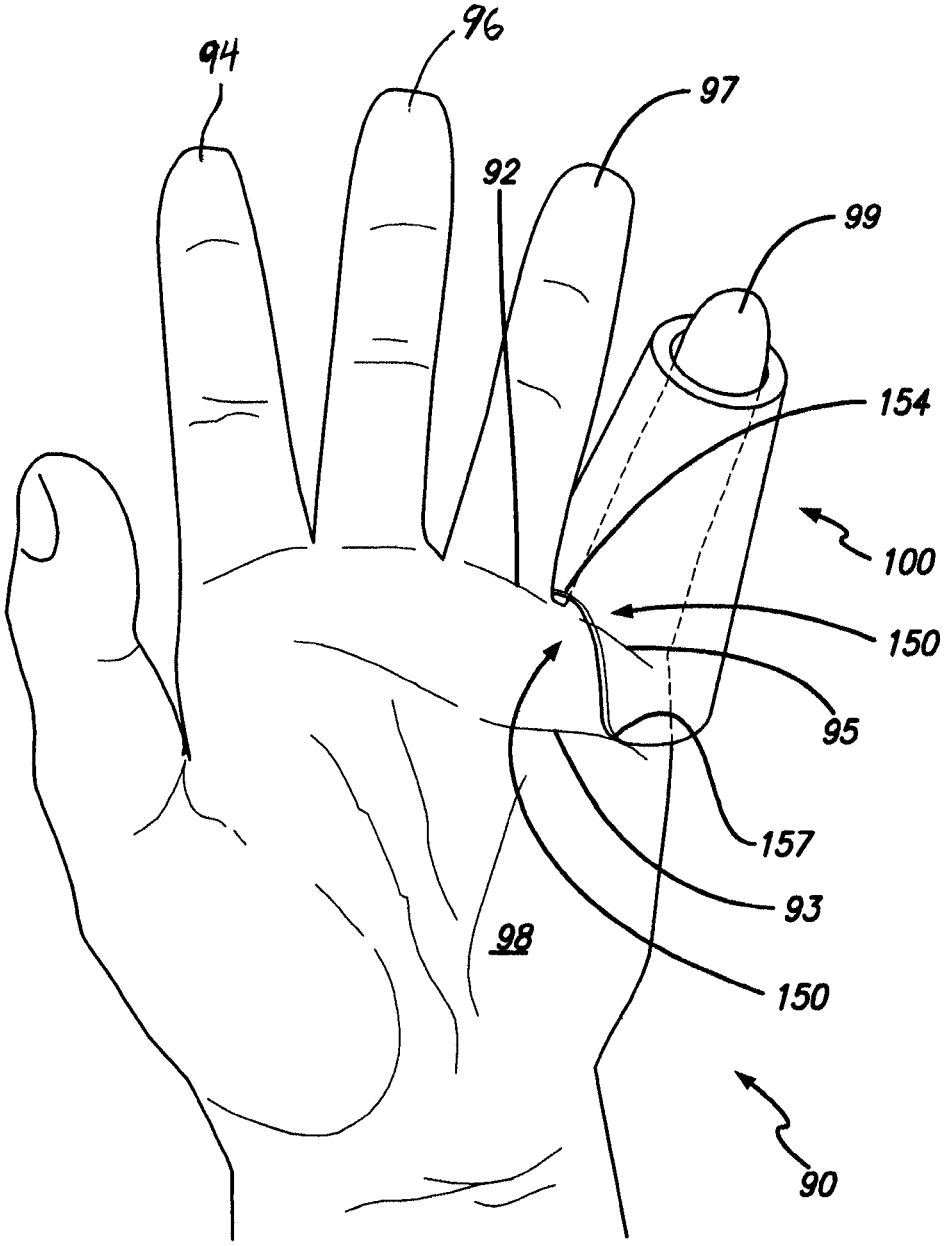
FIG. 2 shows the stringed-instrument slide of the present invention worn on the pinky finger of a musician.

As shown in FIG. 2, the contour of the cut-away (150) is such that a substantial portion of the weight of the slide (100) is born along the palm (98), instead of at the finger joint (95). The contour of the cut-away (150) distributes the weight of the slide (100) evenly along a contour across the palm (98) beginning at the top of the palm (98) between the pinky-palm joint (95) and ring finger-palm joint (92), and ending at or slightly above the largest topmost crease in the palm (93). The cut-away (150) has a central concave downwards portion (152) which is roughly semi-circular, and is concave upwards at the edges (157) where it meets the bottom edge (130) of the slide (100). The central portion (152) of the cut-away (150) has an edge which is beveled at an angle θ from the longitudinal axis (105) of preferably between 40° and 70°, more preferably between 45° and 65°, more preferably between 50° and 60°, and still more preferably roughly 55° relative to the longitudinal axis (105) of the slide (100).

The slide (100) of the present invention is designed so that the inner diameter at the top is somewhat greater than the width of the pinky finger (99) near the top knuckle, and the inner diameter near the apex (154) of the cut-away (150) is substantially greater than the width of the base of the pinky finger (99). As discussed in detail below, this allows the slide (100) of the present invention to teeter on the pinky finger (99). This is to be contrasted with traditional slides which are generally designed to provide a tight fit on the playing finger and looseness is considered a disadvantage.

According to the present invention, preferably the height of the slide (100) is between 5.0 cm and 7.5 cm, the outer diameter of the slide (100) at the top is between 2.5 cm and 3.8 cm, the outer diameter of the slide (100) at the bottom is between 3.3 cm and 5.4 cm, the wall thickness (i.e., the thickness transverse to the longitudinal axis (105)) is between 0.4 cm and 0.6 cm, and the cut-away (150) has a width at the base of the slide (100) of between 2.1 cm and 3.9 cm and a height from the base of the slide (100) to the apex (155) of the cut-away (150) of between 0.5 cm and 1.5 cm. Still more preferably, the height of the slide (100) is between 5.6 cm and 6.5 cm, the outer diameter of the slide (100) at the top is between 2.8 cm and 3.3 cm, the outer diameter of the slide (100) at the bottom is between 3.8 cm and 4.6 cm, the wall thickness is between 0.45 cm and 0.55 cm, and the cut-away (150) has a width at the base of the slide (100) of between 2.7 cm and 3.3 cm and a height of between 0.8 cm and 1.2 cm. Most preferably, the height of the slide (100) is about 6.0 cm, the outer diameter of the slide (100) at the top is about 3.0 cm, the outer diameter of the slide (100) at the bottom is about 4.1 cm, the wall thickness (i.e., the thickness transverse to the longitudinal axis (105)) is about 0.5 cm, and the cut-away (150) has a width at the base of the slide (100) of about 3.0 cm and a height of about 1.0 cm. The flare angle ϕ of the conical outer surface (120) is preferably between 3° and 25°, more preferably between 4° and 15°, more preferably between 5° and 10°, more preferably between 6° and 9°, and still more preferably between 7° and 8°. It should be noted that the flare angle ϕ of the conical outer surface (120) need not be the same as the flare angle ψ of the conical inner surface (119). In fact, a flare angle ψ of the conical inner surface (119) which is less than the flare angle ϕ of the conical outer surface (120) is advantageous according to the present invention because that produces a greater wall thickness at the bottom and therefore a lowered center of mass.

The outer diameter at the bottom (130) is greater than the outer diameter at the top (110) of the slide (100) by between 15% and 45%, more preferably between 20% and 40%, still more preferably between 25% and 35%, and most preferably roughly 30%. Furthermore, the height of the cut-away (150) along the longitudinal axis (105) is between 5% and 35%, more preferably between 8% and 28%, more preferably between 12% and 22%, and most preferably roughly 16% of the height along the longitudinal axis (105) of the slide (100). (According to the lexography of the present specification and claims, "roughly" should be taken to mean plus or minus 10% of the value referred to.)

According to the present invention the outer diameter at the bottom of the slide (100) is greater than the inner distance between the base of the pinky finger (99) and the base of the middle finger (96), i.e., the distance between the left edge of the base of the pinky finger (99) and the right edge of the base of the middle finger (96) of the left hand (98) shown in FIG. 2. Typically, the inner distance between the base of the pinky finger (99) and the base of the middle finger (96) of a human hand is at most about 3 cm. Furthermore, according to the present invention the outer diameter at the bottom of the slide (100) is also greater than the inner distance between the base of the ring finger (97) and the base of the pointer finger (94), i.e., the distance between the left edge of the base of the ring finger (97) and the right edge of the base of the pointer finger (94) of the left hand (98) shown in FIG. 2. Typically, the inner distance between the base of the ring finger (97) and the base of the pointer finger (94) of a human hand is at most about 3.5 cm. It should therefore be noted that the slide (100) of the present invention cannot be worn on the ring finger (97) or middle finger (96). (However, the slide (100) of the present invention could be worn on the pointer finger (94) with the apex (154) of the cut-away (150) located between the pointer finger (94) and the middle finger (96).) With reference to the dimensions of the hand (98), according to the present invention the ratio of the outer diameter at the bottom of the slide (100) to the inner distance between the base of the pinky finger (99) and the base of the middle finger (96) is preferably greater than or equal to 1.1, more preferably greater than or equal to 1.2, still more preferably greater than or equal to 1.3, and still more preferably greater than or equal to 1.4.

The slide (100) may be used on any stringed instrument and is particularly useful on low-tension stringed instruments, such as banjo or nylon-string guitar, and low-fretted stringed instruments, such as many electric guitars. As is shown in FIG. 2., the slide (100) is preferably worn on the pinky (99) of the hand (90) with the apex (154) of the cut-away (150) located at the top of the palm (98) between the pinky (99) and ring finger (97). Typically, the pinky finger (99) is held at around 30° from vertical when a slide, such as the slide (100) of the present invention, is used. An important aspect of the present invention is that the center of mass of the slide (100) relative to the hand (90) is substantially shifted compared to that of a simple cylindrical slide because of the geometry, dimensions and weight distribution—in particular, because of the cut-away (150) and the conical shape of the slide (100) with the bottom (130) having a larger diameter than the top (110). Because a substantial portion of the mass of the slide (100) is located below the pinky-palm joint (95), the center of mass is lowered compared to that of a simple cylindrical slide. Having the slide (100) of the present invention "balanced" so that the center of mass is located near the pinky-palm joint (95) and having the inner diameter of the slide (100) being greater than the width of the pinky finger (99) at corresponding heights (i) allows the mass of the slide (100) to be predominantly born by the region of contact of the slide (100) with the palm (98) rather than along the pinky (99), and (ii) allows the slide (100) to teeter on the hand with a pivot point at or near the pinky-palm joint (95). Therefore, the slide (100) has the sensation of being relatively weightless on the pinky (99) itself. Furthermore, the pressure applied by the pinky (99) corresponds closely to the actual pressure of the slide (100) on the strings, rather than, as is the case with slides other than that of the present invention, there being an offset between the pressure applied by the finger and the pressure of the slide on the strings due to the weight of the slide (100).

According to the preferred embodiment of the present invention, the ratio of vertical distance (i.e., the distance along the longitudinal axis of the slide (100)) between the apex (154) of the cut-away (150) and the center of mass of the slide (100) to the vertical distance between the apex (154) of the cut-away (150) and the top (110) of the slide (100) is less than 0.45, more preferably less than 0.40, more preferably less than 0.35, still more preferably less than 0.30, and even more preferably less than 0.25. Furthermore, when mounted on the pinky (99) with the pinky (99) pointing upwards, the portion of the mass of the slide (100) below the finger-palm joint (95), i.e., the portion of the mass of the slide (100) below the apex (154) of the cut-away (150), is preferably greater than 5%, more preferably greater than 10%, more preferably greater than 15%, more preferably greater than 20%, still more preferably greater than 25%, still more preferably greater than 30%, and still more preferably greater than 40%. For a balanced slide according to the preferred embodiment where the height of the slide (100) is 6.0 cm, the outer diameter of the slide (100) at the top is 3.0 cm, the outer diameter of the slide (100) at the bottom is 4.1 cm, the wall thickness is about 0.5 cm, and the apex (154) of the cut-away (150) is 1.0 cm above the bottom edge (130) of the slide (100), the ratio of vertical distance between the apex (154) of the cut-away (150) and the center of mass of the slide (100) to the vertical distance between the apex (154) of the cut-away (150) and the top (110) of the slide (100) is 0.38, and the portion of the mass below the apex (154) of the cut-away (150) (i.e., the finger-palm joint) is about 30%. In contrast, for a standard cylindrical slide, the center of mass is halfway up the slide so the ratio of the vertical distance between the point of contact with the top of the palm and the center of mass to the vertical distance between the point of contact with the top of the palm and the top of the slide is 0.5, and the portion of the mass below the finger-palm joint is 0%.

According to Parallel-Axis Theorem of rotational dynamics, the total moment of inertia I for rotation of an object about a rotation point P is the sum of the moment of inertia $I_{CM}$ about a parallel axis of rotation through the center of mass of the object and the moment of inertia $I_p$ about the initial axis of rotation provided by a point mass having the total mass m of the object and being located at the center of mass of the object. Therefore, because the slide (100) of the present invention is balanced so that the center of mass is relatively near the pivot point of the pinky-palm joint (95), the moment of inertia I is reduced to a value near $I_{CM}$, and therefore the forces and torques required to move the slide (100) onto and off of the strings is reduced, thereby facilitating play, particularly rapid and/or nuanced play.

Thus, it will be seen that the improvements presented herein are consistent with the objects of the invention for a balanced stringed-instrument slide described above. While the above description contains many specificities, these should not be construed as limitations on the scope of the invention, but rather as exemplifications of preferred embodiments thereof. Although the present invention is described in terms of a pinky slide, the concepts and principles presented herein may be adapted for a middle or ring finger slide. Many other variations are also within the scope of the present invention. For example: the dimensions may be other than what is specified; the outer surface and/or the inner surface may not be conical; only a portion of the outer and/or inner surfaces may be conical; the slide may not have mirror/two-fold symmetry; the slide may have a non-constant specific gravity—for instance, the lower region may have a specific gravity greater than that of the upper region; the slide may be used on the pointer finger; other materials may be used; etc. Furthermore, the description of the physical principles underlying the operation and performance of the present invention are described as presently understood, but may include approximations, simplifications and assumptions and are not intended to be limiting.

Accordingly, it is intended that the scope of the invention is determined not by the embodiments illustrated or the physical analyses motivating the illustrated embodiments, but rather by the appended claims and their legal equivalents.

What is claimed is:

1. A stringed-instrument slide comprising:

a substantially conical inner surface having an inner upper diameter less than an inner lower diameter and defining a housing for an upwards-oriented pinky finger of a human hand, a hard, substantially conical outer surface for providing a sliding stop on a string on a stringed-instrument and having an outer upper diameter less than an outer lower diameter, and a crescent-shaped cut-away along a bottom edge of said slide, the apex of said cut-away to be positioned at a finger-palm border between said pinky finger and a ring finger of said hand, said inner upper diameter being greater than a top width of said pinky at a corresponding height, an inner diameter of said conical inner surface at said apex of said cut-away being greater than a base width of said pinky, said outer lower diameter being greater than a first inner distance between said pinky finger and a middle finger of said hand, and said outer lower diameter being greater than a second inner distance between said ring finger and a pointer finger of said hand.

2. The stringed-instrument slide of claim 1 wherein said positioning of said apex of said cut-away at said finger-palm border results in a portion of a total mass of said slide being below said finger-palm border of said hand.

* * * * *